US008105125B2

(12) United States Patent
Sick

(10) Patent No.: US 8,105,125 B2
(45) Date of Patent: Jan. 31, 2012

(54) BODY SURFING METHOD AND APPARATUS

(76) Inventor: Michael Sick, San Diego, CA (US)

( * ) Notice: Subject to any disclaimer, the term of this patent is extended or adjusted under 35 U.S.C. 154(b) by 43 days.

(21) Appl. No.: 12/336,468

(22) Filed: Dec. 16, 2008

(65) Prior Publication Data

US 2009/0156072 A1 Jun. 18, 2009

Related U.S. Application Data

(60) Provisional application No. 61/014,681, filed on Dec. 18, 2007.

(51) Int. Cl.
*A63B 31/00* (2006.01)
*A63B 31/08* (2006.01)
*A63B 31/10* (2006.01)

(52) U.S. Cl. ..... 441/56

(58) Field of Classification Search ..... 441/55–59, 441/60, 65; 434/254; D21/806, 807
See application file for complete search history.

(56) References Cited

U.S. PATENT DOCUMENTS 2,006,915 A * 7/1935 Ferber ..... 441/56
3,122,760 A * 3/1964 Glass, Jr ..... 441/57
3,185,476 A * 5/1965 Fechner ..... 473/596
3,802,009 A * 4/1974 Clemente ..... 441/57
3,942,205 A * 3/1976 Lind ..... 441/56
4,240,171 A * 12/1980 Parsons ..... 441/56
4,437,842 A * 3/1984 Connor ..... 441/65
4,832,643 A * 5/1989 Schoofs ..... 441/56
5,167,551 A * 12/1992 Davis ..... 441/57
6,544,089 B2 * 4/2003 Zapatero ..... 441/65
D549,636 S * 8/2007 Dial ..... D12/300

* cited by examiner

*Primary Examiner* — Ajay Vasudeva
(74) *Attorney, Agent, or Firm* — James D. Leimbach

(57) ABSTRACT

A buoyant device that enhances water activities and surfing by providing increased thrust from incident waves through utilization of a surface or volume to propel the buoyant device. A buoyant enclosure with an internal hand grip has surfaces that promote hydroplaning, flotation and the reduction of friction through the shape, materials and laminations used to manufacture the device. At least one of the surfaces can engage moving water allowing a user to benefit from the thrust of a wave to increase propulsion. A shape that combines a planar bottom surface with planar area to at least one side surface forms a wave wall to enhance propulsion from the force of a wave. Hydroplaning is enhanced using material with increased buoyancy to improve the body surfing experience. The devices are hand held by the user and can be used independently or combined to function as a single device. A "bow" like shape can be created by placing devices on both the left and right hand components together as a method of utilizing the system to efficiently cut through the water while simultaneously hydroplaning.

17 Claims, 7 Drawing Sheets

BODY SURFING METHOD AND APPARATUS

BACKGROUND OF THE INVENTION

1. Field of the Invention

The invention relates generally to aquatic activities and, more particularly, to accessories used for assisting in aquatic activities.

2. Description of the Prior Art

Wave riding is an activity that provides enjoyment for many people around the world. In order to ride waves, a number of sports have been invented to assist people in riding waves toward the shore. Surfing is a common pastime among residents and visitors in coastal areas. Surfing requires a level of skill that has a long learning curve and a substantial investment in equipment that tends to be bulky and increasingly expensive as the performance of the equipment increases. Another manner of wave riding is body surfing. Body surfing does not require the high level of skill of surfing on a surfboard and the equipment is much less expensive. Numerous prior art devices exist that can enhance the body surfing experience. A number of hand boards that currently exist for body surfing are generally buoyant, flat, planar devices. Additionally, a number of devices exist that can be used on the individual hands of the user to provide assistance in swimming but do not provide a high degree of buoyancy.

The Handboard™ marketed by The Hand Board Company in Kailua Hawaii is an example of a flat planar device that tapers towards the front. The Handboard™ provides a limited amount of buoyancy; however, the Handboard™ does not easily attach to the hands of the user and does not provide any assistance in swimming. Moreover, Handboards™ suffer from high costs of manufacturing making them somewhat cost prohibitive.

Other planer devices marketed as the Aloha Board™ or the Hand Cannon™ are individual planer devices with tapering fronts used that are attached with an attachment mechanism to each hand of the user. Each of these devices provides only limited amounts of buoyancy that is limited and these devices are essentially planar devices. These devices also are generally expensive to manufacture making them somewhat cost prohibitive.

Wave Blades® are other currently available planer devices that comprise tapered planer boards with a glove like attachment mechanism for the user's hand. These devices are expensive to construct, requiring sizing of the user's hand and offer only limited amounts of buoyancy. The glove like attachment used on these devices can be difficult to attach to the user and also difficult to remove. Additionally, here are also a number of hard surfaces on these devices which can cause injury to other swimmers in the event of a collision.

Other devices that can be used for body surfing are pod like devices or miniature surf boards. These devices are intended to held with both hands and do not provide individual body surfing devices for each hand. They are larger, more cumbersome devices than the individual hand devices described above and their manufacturing costs are high.

In view of the foregoing discussion there remains a need within the art for a device that provides substantial amounts of buoyancy, assists in swimming and is more economical to manufacture.

SUMMARY OF THE INVENTION

The present invention addresses the above discussed shortcomings within the prior art by allowing a body surfer to enhance the body surfing experience at a reasonable cost by providing a device for use in water comprising: a buoyant device having a tapering first end and a second end opposite the first end that defines a wave wall.

An embodiment provides a water sports device that can be economically manufactured.

Another embodiment provides a water sports device that can easily be placed on the hands of a user and easily removed.

Another embodiment provides a device that will assist the user in body surfing.

Another embodiment provides that will provide buoyancy.

An embodiment provides a device that will assist the user in swimming.

Another embodiment provides a water sports accessory that can capture force from a wave and use that force to propel the user.

DETAILED DESCRIPTION OF THE DRAWINGS

Figure 1:
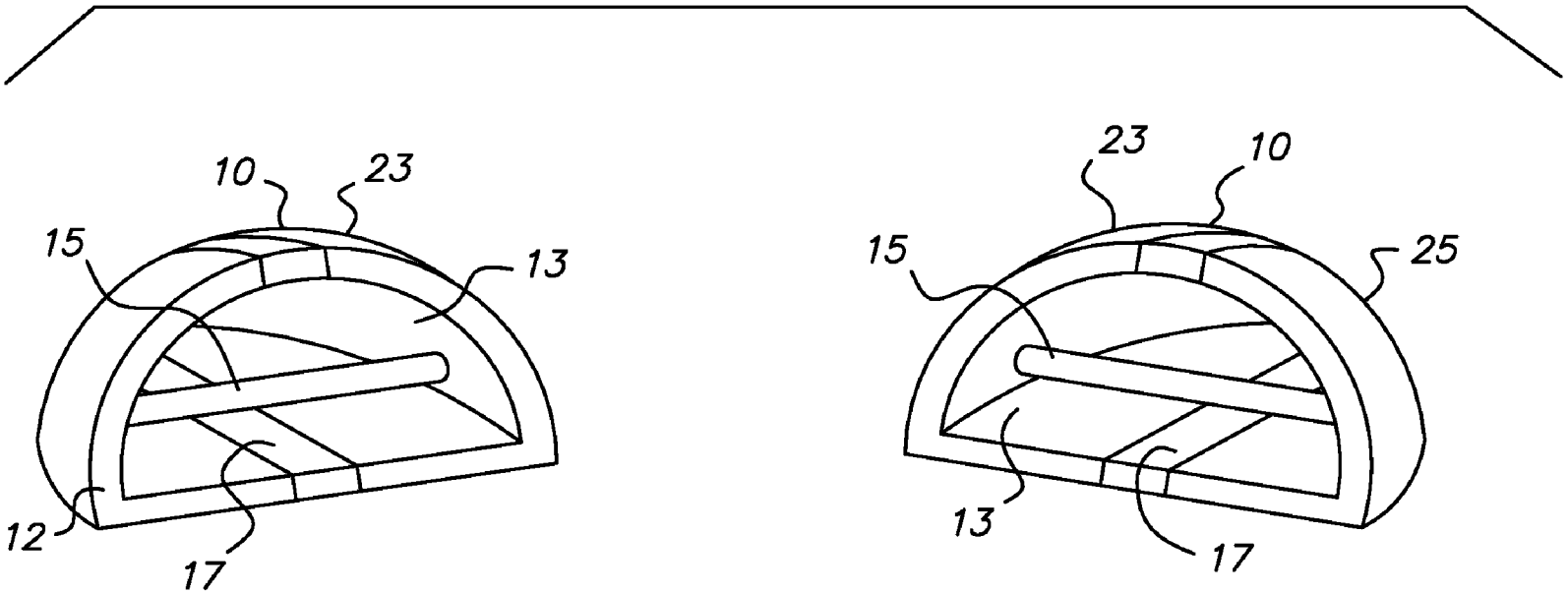
FIG. 1 is a view of an embodiment for a hand enclosure device illustrating the backsides with hand access area and the grips.

FIG. 1 is an illustration of a first embodiment comprising an identical pair of buoyant hand enclosures 10 each having a backside 12 defining an opening 13 that is large enough for a human hand to be inserted into hollow volume 14. The interior to each hand enclosure is a hollow volume 14 with a grip 15 that is formed to allow users to hold the hand enclosures 10. The hand enclosures 10 have a bottom surface 17 that can be essentially flat, or has a substantially flat portion on the outside of the bottom of the hand enclosure 10 to provide a surface to that can hydroplane over water.

The term wave wall as used herein refers to a surface that has a curved area or contained volume that can harness forces from moving fluids incident on the wave wall, such as water, to propel the wave wall in the direction of the moving fluid.

The material used to construct hand enclosures 10 has a thickness viewed from backside 12, that may be placed perpendicular to the force of on coming waves during use. Hand enclosures 10 define openings 13 and interior hollow volume 14 that allows water from a wave to enter hollow volume 14 and apply a force to the interior of the front sides 22. The water from on rushing waves can enter hollow volumes 14 and force the user holding on to hand enclosures 10 forward with the force of the wave and thus hollow volume 14 would be a wave wall. The thickness of the material used to construct hand enclosures 10 viewed from backside 12 will be a further resistance to oncoming waves and also apply a force that forces the user forward from the force of oncoming waves.

Figure 2:
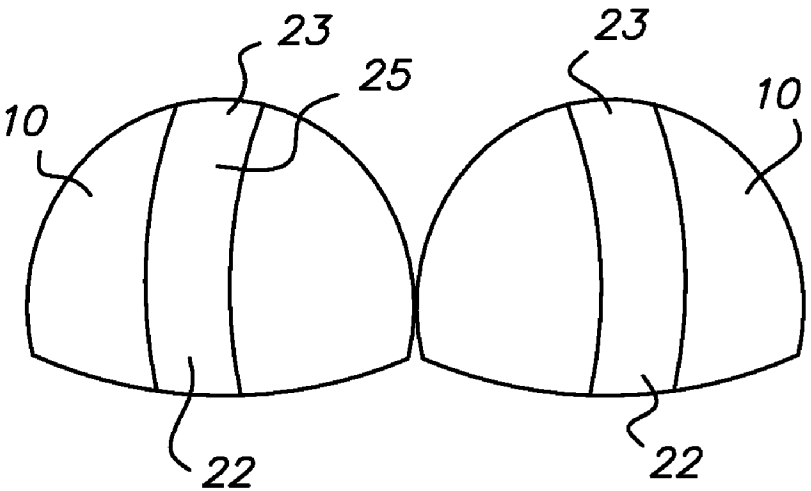
FIG. 2 is another view of the embodiment shown in FIG. 1 illustrating the fronts.

FIG. 2 is a view of the hand enclosures 10 shown in FIG. 1 illustrating the front sides 22 that taper towards the front sides and can be rounded. As seen in FIGS. 1 and 2, hand enclosures 10 have top surfaces 23 that taper towards front sides 22 and are essentially flat towards backsides 12. Each of top surfaces 23 defines a curvature 25 as the top surface 23 extends towards the tapered front side 22. The tapered front side 22 and curvature 25 provide a shape that can penetrate through water with low resistance yet still provides sufficient room for hollow volume 14 within the hand enclosure 10 that allows a human hand to easily fit inside hollow volume 14 and hold grip 15. FIG. 2 illustrates both hand enclosures 10 placed abutting each other forming a single, larger bottom surface 17 that can enhance the body surfing activity. Using both hand enclosures together increases the size of the wave wall in that both hollow volumes 14 are placed next to each other and together with the thickness of the material used to construct hand enclosures 10, forms a larger surface to capture the force of the wave. A user can also place the bottom surfaces 17 of the hand enclosures 10 together to form a larger wave wall.

The embodiment illustrated in FIGS. 1 and 2 represents an economical version in which each of the hand enclosures 10 is identical. Therefore, only a single manufacturing process or a single mold needs to be implemented. The design shown in FIGS. 1 and 2 is a low cost alternative to prior art devices that can be much more expensive. Another embodiment will tailor hand enclosure 10 such that there will be separate hand enclosures for the left and right hand of the user.

As can be seen from the embodiment illustrated in FIGS. 1 and 2, the hand enclosures 10 are rounded in shape. While the backsides 12 are shown as being semi-circular with hand enclosures 10 being formed as a quarter of a sphere, it should be noted that hand enclosures 10 could be formed with either of the dimensions of backsides 12 accentuated such that backsides 12 are more semi-elliptical in shape. Additionally, the entire device could be formed in the shape of a quarter of an ellipsoid rather than a quarter of a sphere. The hand enclosures 10 shown in FIGS. 1 and 2 are easy to slip on and off the human hand and therefore straps and glove like mechanisms that are difficult to attach are avoided. It should also be noted that the shape of hand enclosures 10 illustrated in FIGS. 1 and 2 do not present any edges extending outward which prevents potential damage to a person, such as an accidental contact with a person's eye.

The embodiment illustrated in FIGS. 1 and 2 shows an apparatus that utilizes the bottom surface 17 as a planer surface that can hydroplane across the water to provide user with enhanced capabilities and enjoyment of water activities, such as body surfing. The materials that are used in the construction of the hand enclosures 10 illustrated in FIGS. 1 and 2 provide increased buoyancy. The buoyancy is derived from the material used to form the hand enclosures 10. The hand enclosure 10 is made to be inherently buoyant by selection of materials and allows the hands and the wrists of the user that are contained within the hand enclosure 10 to observe a positive buoyancy that provides assistance in the water. The buoyancy provided by the hand enclosures 10 can be used as a flotation device, to tread water, to swim or to assist in body surfing. The hand enclosures 10 can be formed such that bottom surface 17, or a portion thereof, can assist in riding waves. The inherent buoyancy of the hand enclosure 10 combined with the planar shape of the bottom surface 17 allows for a user to control their body and to counteract the relative negative buoyancy of the human body. The positive buoyancy of the hand enclosure 10 can provide assistance in controlling the body position of the user while riding waves and also provides assistance towards general flotation.

The inherent buoyancy of hand enclosures 10 can be achieved through the utilization buoyant materials used to form hand enclosures 10. These buoyant materials can be plastic, open cell foam, closed cell foam, fiberglass, metal, wood, polystyrene foam, inflatable materials or other materials which are inherently buoyant.

Hand enclosures 10 can be used as two separate components held in each the right and left hands of the user. The hand enclosures 10 can also be combined to provide a larger, essentially single surface for an increased hydroplaning effect. By holding the hand enclosures 10 together a larger, more buoyant apparatus is formed. Thus, the hand enclosure 10 illustrated in FIGS. 1 and 2 can provide independent action for each hand similar to hand paddles known in the prior art or the hand enclosures 10 can be combined to function as a two handed body surfing apparatus known in the art.

Forming hand enclosures 10 as a quarter sphere or a quarter of an ellipsoid allows the user to place planer portion of bottom surfaces 17 together such that flat bottom surfaces 17 are held together creating a larger wave wall with virtually no room for water to fit between the closely held planer portions of bottom surfaces 17 of hand enclosures 10. The round front sides 22 provide a tapering surface to break through the water while the outsides sides to hand enclosures 10 can be formed to have a flat portion that can provide a hydroplaning affect. The incident wave can be used to provide propulsion not 10 simply by hydroplaning but also by the force of the water from the wave smashing into the contained volume created by the hollow interiors 14 and the force of the smashing water used to propel the user holding the hand enclosures 10 forward under the force of the on coming wave.

Various embodiments are possible. A wave wall can be formed by a curved area and not necessarily a contained volume. For example a relatively planar hand board could be configured with a curved area on a surface of the planar board to catch the force the water from a wave. Planar boards can be fashioned such that there is a curved surface in the rear of the board that is concave to the on coming water in a wave. This curved surface could also be fashioned as a contained volume with enclosing sides on either side of the planar board. Such planar boards can be fashioned such that the side of the curved surface facing the front of the planar board places little or no resistance to hydroplaning. A planar board could be designed such that the board tapers from rear towards the front and the backside is shaped as a wave wall, or a wave wall type surface formed adjacent or near the backside surface. The planar board could be held on the sides by the user or have a handle type mechanism formed on the board.

Figure 3:
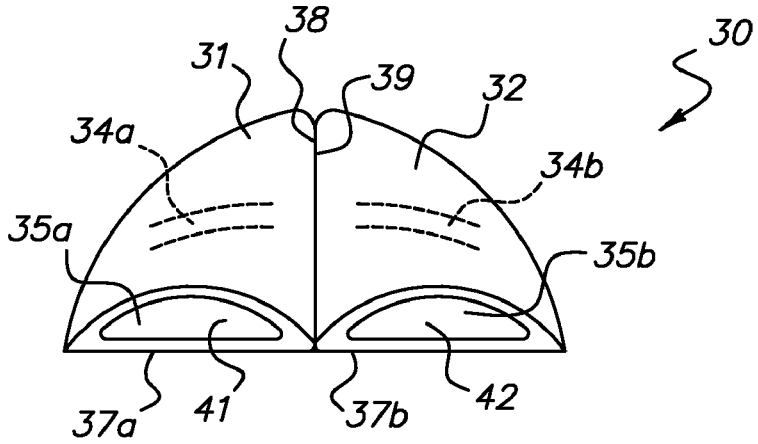
FIG. 3 is a view of a second embodiment of a hand enclosure illustrating a perspective view of the backsides and top surface.

FIG. 3 illustrates a second embodiment for the invention, generally referred to as 30, wherein left hand enclosure 31 and right hand enclosure 32 are formed individually for each hand of the user. Left hand enclosure 31 defines hollow cavity 41 and right hand enclosure 32 defines hollow cavity 42 that are accessible through, respectively, openings 35*a* and 35*b*. Left hand enclosure 31 has bottom surface 37*a* and right hand enclosure 32 has bottom surface 37*b*, which bottom surfaces 37*a*, 37*b* have a flat area. In FIG. 3, it can be seen that left inside edge 38 and right inside edge 39 are essentially straight edges and can be placed together. Left hand enclosure 31 and right hand enclosure 32 can be placed together to form a single shape with an extended bottom surface that includes both bottom surfaces 37*a*, 37*b*. This extended bottom surface can be used similar to a handheld paddle board with the major difference that the hands are inside hand enclosures 31, 32 holding on to gripping mechanisms 34*a* and 34*b*, respectively. The gripping mechanisms 34*a*, 34*b* can be cylindrical in shape to be held in a fist, or rectangular in shape to be held with the thumb below and the fingers held open above the gripping mechanisms 34*a*, 34*b*.

The tapering shape formed by left hand enclosure 31 and right hand enclosure 32, is readily apparent from the more of a top down perspective view of FIG. 3. The tapering shape shown in FIG. 3 can be semi-circular or semi-elliptical. Additionally, left hand enclosure 31 and right hand enclosure 32 can be formed such that the side edges 38, 39 form essentially right angles between each bottom surfaces 37*a*, 37*b*. Once a wave arrives, the surfer can place the side edges together to form a larger surface and a larger wave wall for the wave to be incident upon. Bottom surfaces 37*a*, 37*b* can also be placed together to form a larger surface and a larger wave wall for the wave to be incident upon.

The side edges 38, 39 can then walls to hand enclosures 31, 32 can be formed to have a flat portion on the outside edges that can be used to hydroplane if the user places bottom surfaces 37*a*, 37*b* together to form a larger wave wall. By placing bottom surfaces 37*a*, 37*b* together, the force of the wave used to propel the user is increased by creation of a larger surface and a larger wave wall that is being applied to the wave. Using a wave wall design allows for hand enclosures 31, 32 to be separated, twisted or held together and the user still can enjoy the responsiveness from the force of wave.

Figure 4:
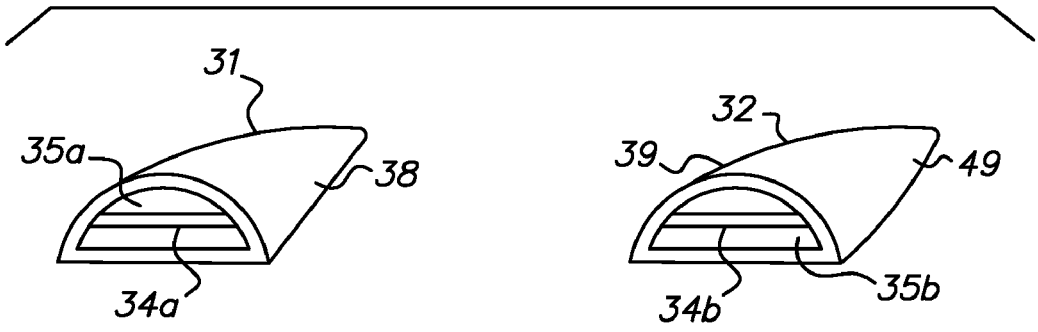
FIG. 4 is another view of the second embodiment shown in FIG. 3 illustrating more of a side view.

FIG. 4 illustrates side views of left hand enclosure 31 showing left inside edge 38 and right hand enclosure 32 showing right outside edge 49. As shown in FIG. 4, the dimensions of hand enclosures 31, 32 as viewed from the side are more elliptical in shape. Thus, the embodiment shown in FIGS. 3 and 4 is somewhat more flattened out than the embodiment shown in FIGS. 1 and 2. The hand enclosures 31, 32 can be placed together to create a larger surface and a larger wave wall by the combined bottom surfaces 37*a*, 37*b*. The larger surface could be semi-circular, semi-elliptical or a variety of shapes. The gripping mechanisms 34*a*, 34*b* can cylindrical in shape or rectangular or square in cross section so that a human hand wrapped around them. The gripping mechanisms 34*a*, 34*b* can be formed to allow the hand to in an open position with the thumb below and the fingers held open above the gripping mechanisms 34*a*, 34*b*, thereby simulating a swimming motion.

An embodiment such as the one illustrated in FIGS. 3 and 4 can have a straight inside edge and a vertical inside wall at least near the bottoms thus creating devices that would be shaped as an eighth of an ellipsoid or an eighth of a sphere. In these embodiments, the placing of the straight inside edges together would create a unified front for resisting the force of the wave both with the increased surface area of hand enclosures 31, 32 that lay in a plane perpendicular to the direction of the wave and the larger wave wall that is formed by placing hand enclosures 31, 32 together.

Figure 5:
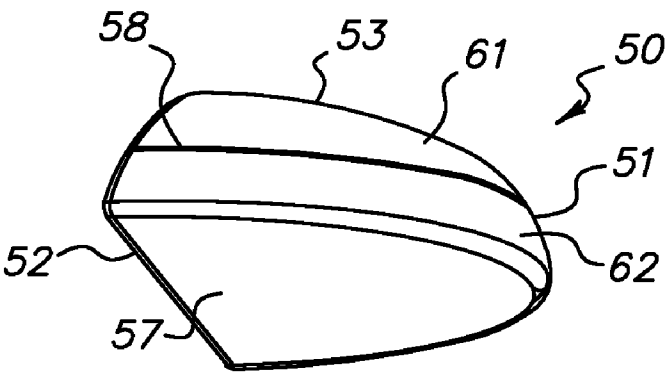
FIG. 5 is a perspective view of a third embodiment of a hand enclosure illustrating bottom and side surfaces and the front side.

FIG. 5 is a view of a third embodiment of a hand enclosure 50 illustrating the bottom surface 57, the side surface 58 and the front side 51. As seen in FIG. 5, hand enclosure 50 has a front side 52 that is substantially rounded in shape. Top surface 53 curves as it extends from the back side 52 towards the rounded front side 51. The rounded front side 51 and curvature of top surface 53 provide a shape that can penetrate through water with low resistance and allow sufficient room within the hand enclosure 50 for the hand of a user. Two hand enclosures 50 can be used by placing one on each the left and right hand of a user. The two hand enclosures 50 can be placed abutting each other forming a single, larger surface area and wave wall volume to, respectively, resist and capture the force exerted by the water of an on coming wave, thus propelling the user. The two hand enclosures 50 can be placed abutting each other such that bottom surfaces 57 are each extended to form a larger bottom surface to engage the force of a wave to increase hydroplaning leading to enhanced body surfing enjoyment. The two hand enclosures 50 can be placed abutting each other such that bottom surfaces 57 are placed together and top surfaces 53 face outwards resulting in a larger wave wall and increased surface area to capture the force of the wave. The two previous means of placing the hand enclosures 50 together both result in increased ability to maneuver through a wave. The individual manner by which hand enclosures 50 are placed into an abutting position results in a different body surfing experience. With the bottom surfaces 57 placed together, an entirely different shape is formed compared to placing bottom surfaces 57 next to each other.

The hand enclosure 50 shown in FIG. 5 can be formed through numerous conventional means. Hand enclosure 50 can be assembled such that the top part 61 and bottom part 62 are fitted together after being molded with the holding device 55 being placed on the inside surface 65 at a junction between the top part 61 and the bottom part 62. Hand enclosures 50 can be molded as a single piece including holding device. Hand enclosures 50 can be formed as a single piece except holding device 55 with the holding device 55 separately attached. Various types of conventional manufacturing procedures can be used to construct hand enclosures 50 and holding device 55.

Figure 6:
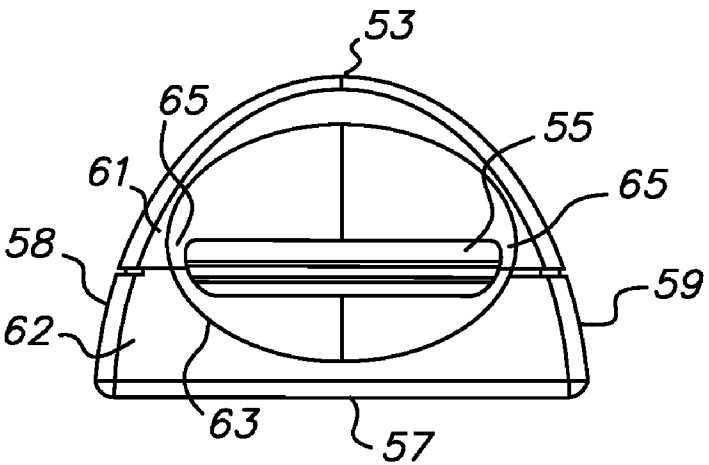
FIG. 6 is a view from the backside of the third embodiment.

FIG. 6 is a view illustrating the backside 52 of the third embodiment. As seen in FIG. 6, backside 52 defines an opening 63 allowing the hand of a user to access the cavity area defined internally to the hand enclosure 50. The internal cavity creates the wave wall that assists in propelling the user from the force of the wave that is captured inside internal cavity. Inside the hand enclosure 50 is a holding device 55 that allows the user to hold on to the hand enclosure 50. The holding device 55 can be attached to an inside surface 65 of the hand enclosure 50, attached to the hand enclosure 50 through holes in the hand enclose, or attached using various connectors and fasteners that are known within the art. The holding device 55 can be cylindrically shaped, have a rectangular cross section, a cross section that contains ridges and valleys for better gripping or virtually any shape that will allow a human hand to grasp and hold the holding device 55.

Figure 7:
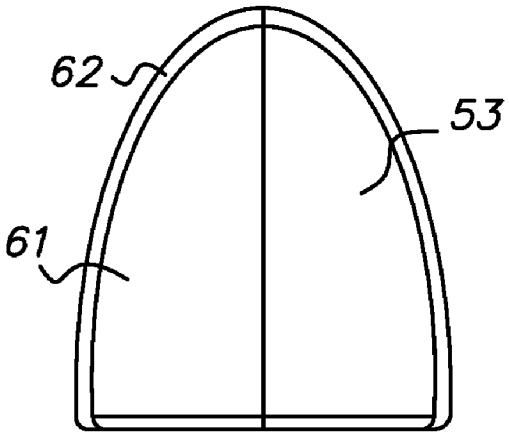
FIG. 7 is a view of the top surface of the third embodiment.

The embodiment illustrated in FIGS. 5, 6 and 7 is a very economical embodiment because the hand enclosures 50 used on the right and left hand of the user are identical. Therefore, only a single manufacturing process or a single mold needs to be implemented. The tooling for the mold used to produce hand enclosure 50 can employ multiple cavities for capacity purposes. Having an identical hand enclosure 50 for each the left and the right hand of the user does simplify the process of manufacturing but is not critical from a tooling standpoint. It should be noted that alterations to make hand enclosure 50 specific for either the left or the right hand are envisioned.

FIG. 7 illustrates a downward looking view of top surface 53 of the third embodiment. As seen in FIG. 7, hand enclosure 50 is semi-elliptical in shape; however, it should be noted that this shape could be semi-circular. Top part 61 and bottom part 62 are clearly visible in FIG. 7. The design of the third embodiment shown in FIGS. 5 and 6 is intended to provide a body surfing device that is extremely useful and produced at a low cost. As shown in FIGS. 5 and 6, hand enclosure 50 has a generally rounded shape as top surface 53 progresses towards the front side 51 and the generally curved form of the top surface as it rounds towards side surfaces 58, 59. The backside 52 and bottom surface 57 are substantially planar. The backside 52 is formed to be essentially semi-circular or semi-elliptical depending on design choice. While the hand enclosures 10 of the first embodiment were constructed as a quarter of a sphere, the hand enclosure 50 of the third embodiment is constructed more as a quarter of an ellipsoid. It should be noted that hand enclosures 50 could be formed with backsides 52 shaped differently being either more flattened out or more elongated and that would change the general shape of the hand enclosure 50. Additionally, the entire device could be formed to more of a quarter of a sphere rather than a quarter of an ellipsoid. The hand enclosure 50 is easy to slip on and off the human hand and alleviates the stress and anxiety that results from attachment mechanisms such as straps and glove like apparatus that are difficult to get on and off the human hand. The rounded shape of hand enclosure 50 prevents edges that could cause injury from extending outwards.

The third embodiment illustrated in FIGS. 5, 6 and 7 is an apparatus that utilizes the bottom surface 57 as a planer surface that can hydroplane across the water to provide a body surfer with enhanced capabilities and enjoyment of water activities, such as body surfing. The internal cavity to each hand enclosure 50 combined with the surface area to the backside 52 use the force of the wave to propel the user. The materials used in the construction of the hand enclosure 50 provide increased buoyancy. The hand enclosure 50 is made to be inherently buoyant by selection of materials allowing the hands and the wrists of the user to observe positive buoyancy in the water. The buoyancy provided by the hand enclosure 50 can be used as a flotation device. The hand enclosures 50 can be formed such to provide planer surfaces in desired areas. For example, a portion of bottom surface 57 can be made planar to use the force of the water in a wave to propel that body surfer. The internal cavity forms a wave wall that captures the force of wave. The wave wall in combination with the surface area of the backside 52, propel the user from the force of the wave. The buoyancy of hand enclosure 50 combined with the planar shape of bottom surface 57 and the flat surface formed by the sides adjacent to the bottom surface provides an additional degree of control of the body surfers body and counteracts the, relatively, negative density of the body.

Figure 8A:
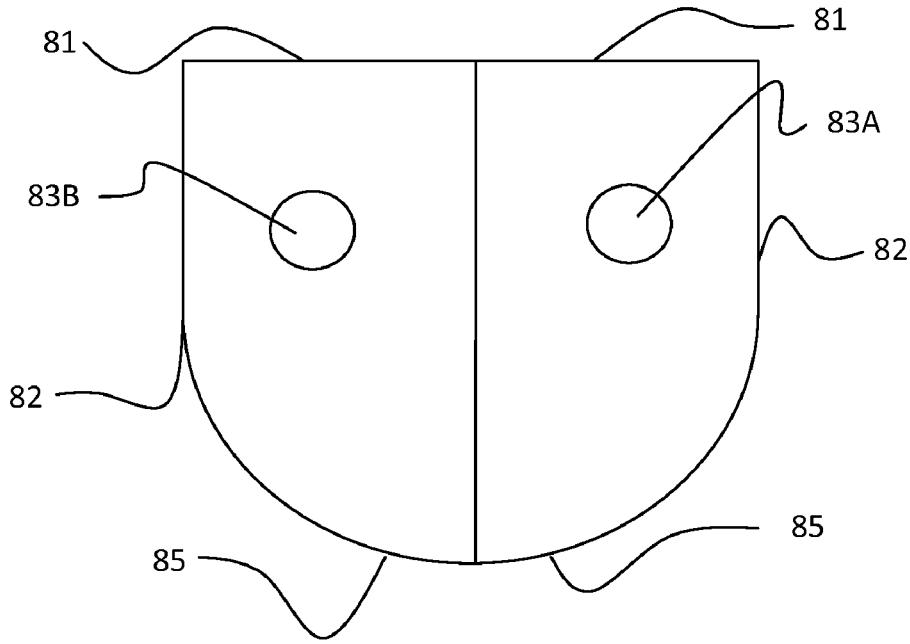
FIG. 8A, 8B and 8C are views of the fourth embodiment.
Figure 8B:
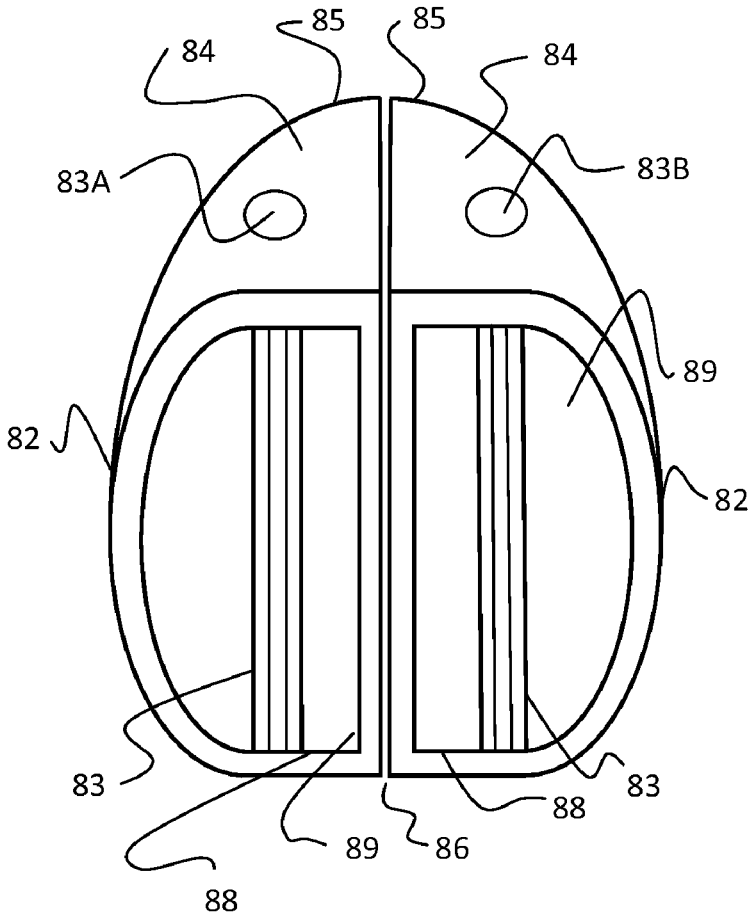

FIGS. 8*a* and 8*b* illustrate a forth embodiment generally referred to as hand enclosure 80 wherein planar portions are provide on the top side 82, side surface 84 and bottom surface 86. FIG. 8A is a side view of two hand enclosures 80 that are placed bottom surface 86 to bottom surface 86. As can be seen in FIG. 8A, the top surface 82 has a flat portion that does not taper immediately from the back side 81. The taper in the shape of hand enclosure 80 does not begin until partway from the back side 81 to the front side 85. This shaping provides for planar surfaces that can be employed to assist the user to body surf and swim. FIG. 8B shows a perspective view from the back side 81 with two hand enclosures 80 being held together at their bottom surfaces 86. Aperture 88 defines an opening for hollow volume 89 inside each hand enclosure. Inside hollow volume 89 is a holding device 83 that has ridges formed on it to allow the user to grasp and hold the holding device 83. The holding device 83 is held in placed by being fitted into a secured arrangement with fasteners 83A and 83B. The hollow volume 89 serves as a wave wall. Once placed together by their bottom surfaces 86, hand enclosures 80 are designed to be usable as a single device that will be propelled by the energy of a wave.

Figure 8C:
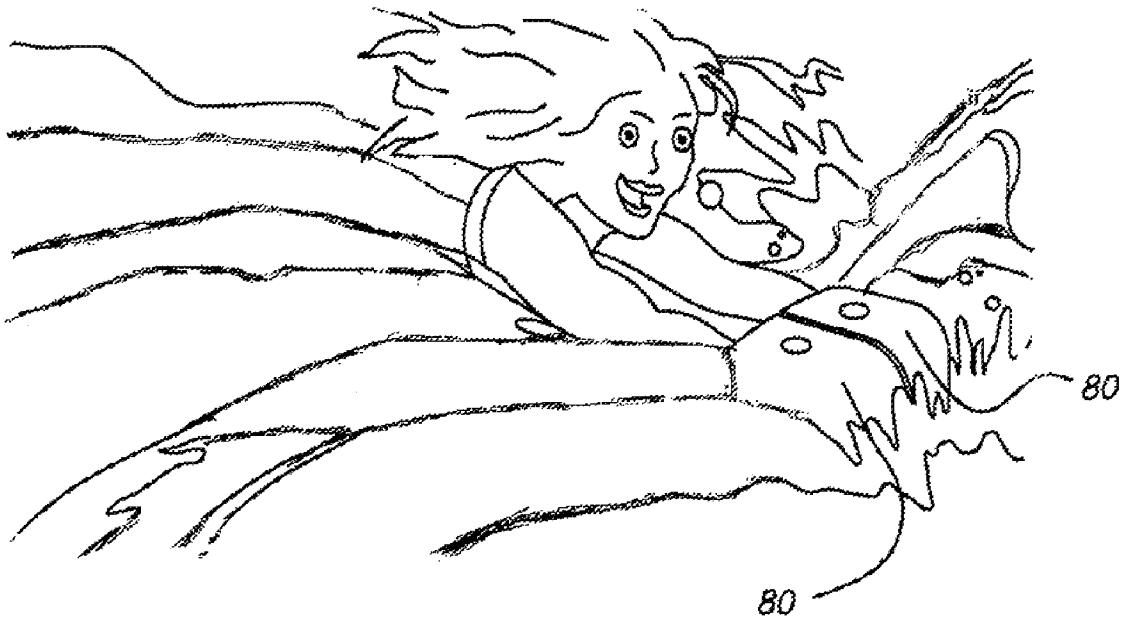

As seen in FIG. 8B, a user can hold one of the holding devices 83 in each hand with the holding device 83 in a vertical position and the bottom surfaces 86 together to form a single tapered shape as shown in FIG. 8C. The energy from the wave will catch the surface area defined by back sides 81 and the wave wall created by hollow interior volume 89. Energy caught from the wave can be used to propel the user forward as illustrated in FIG. 8A. Alternatively, the hand enclosures 80 can be placed side by side and the two adjacent bottom surfaces 86 can form a larger surface for hydroplaning and the surfaces to back side 81 in combination with the wave wall formed from hollow volume 89 will capture energy from the wave to propel forward the user that is grasping the holding device 83.

Figure 9A:
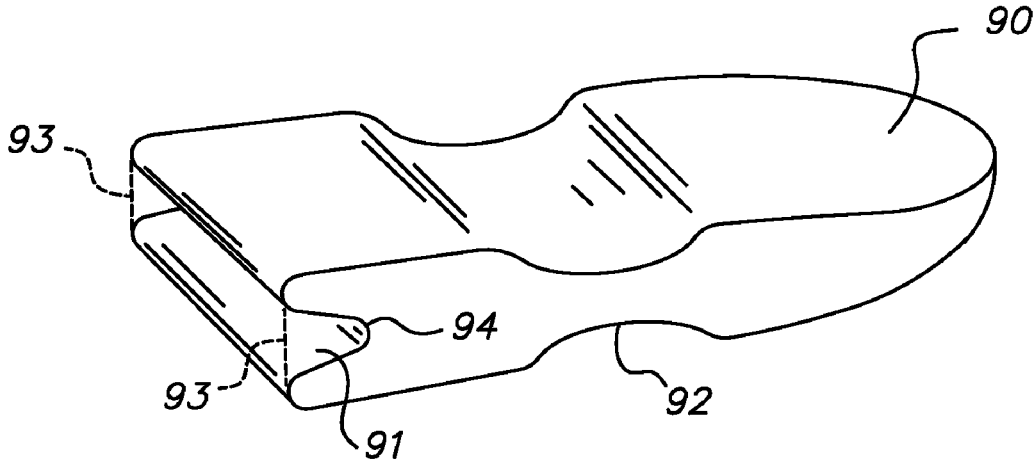
FIGS. 9A and 9B are examples of board embodiments.

The wave wall technology can be employed outside of a hand enclosure embodiment. For example, FIG. 9A is an embodiment for implementing a wave wall on a basically planar board 90. The board has a curved surface 94 formed at the back that can serve as a wave wall and capture energy from an on coming wave. The curved surface 94 can be closed off at either side of the board 90 as shown by dotted lines 93 to contain the volume incident on curved surface 94 and capturing more energy from the on coming wave. The board can be adapted with a holding mechanism 92 as shown in FIG. 9A is so desired.

Figure 9B:
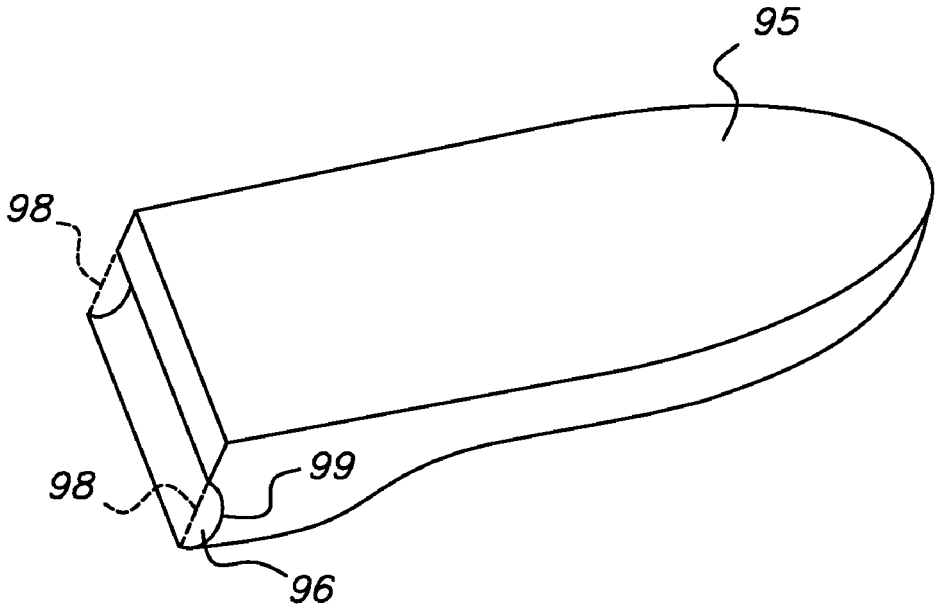

FIG. 9B illustrates a board 95 that has a curved surface 96 defining a hollow interior 99 in the rear of board 95. Curved surface 96 captures the thrust of the wave and forms a wave wall that can assist in propelling user forward. The hollow interior 99 formed by curved surface 96 can be transformed into a contained volume by closing in the sides of the board 95 adjacent curved surface 96. The force from the wave wall formed by the contained volume made from hollow interior 99 will be more powerful than the force from the wave wall created only by curved surface 96. However, both embodiments shown in FIG. 9A and FIG. 9B are envisioned.

The hand enclosures of the foregoing embodiments can be designed with inherent buoyancy that is achieved through the utilization of specific materials to form the hand enclosure. Different embodiments can select the materials to be used from one or more of plastic materials, open cell foam, closed cell foam, fiberglass, metals, woods, Styrofoam, inflatable materials or other materials which have the benefit of creating buoyancy. In one particular embodiment, Expanded Polyethylene (EPE) is used for the paddles. Other forms of plastics or lightweight materials could also be used. In another specific embodiment, the handles and pins are constructed using acrylonitrile-butadiene-styrene (ABS) and Nylon either alone or in combination.

A method utilizes formation of hand enclosures that have a shape that allows the user to place the left and right hand enclosures together creating a larger, more buoyant device. The method utilizes the system comprising two hand enclosures to efficiently hydroplane on an effectively a single larger surface. The tapering shape of the two hand enclosures creates a "bow" like shape that can cut through water allowing for movement through the water. The hand enclosures also provide flat surfaces which can be placed perpendicular to the surface of the water allowing the thrust of a wave to increase propulsion of the user. The thrust of the wave can be further harnessed to by the hollow interior to the hand enclosure. A user can selectively hydroplane across the top of the water or catch the water for propulsion, or a combination of both. Differing embodiments can implement individual left and right hand enclosures with straight inside edges to be placed together forming virtually a single board. Embodiments can also be designed for a hand enclosure that can be used on either the left or right hand, thus providing a design that minimizes manufacturing cost and still allows users to place the left and right hand enclosures together to create a single apparatus effect.

The above embodiments describe an accessory that enables users to body surf at a higher skill level as a result of the physics provided by the buoyancy, hydro planning and forward thrust elements. These embodiments illustrate two components that are designed to be held in separate hands by the user. Each of the embodiments describes surfaces designed to promote hydroplaning, flotation and the reduction of friction through the shape, materials and laminations used to manufacture the invention. Additionally, the surfaces can be utilized to display various brands and graphic designs including logos, shark teeth, sea life, colors and other graphics.

The foregoing discussion describes embodiments that can be used by a person skilled in the art to make and use a device useful in bodysurfing. These embodiments are simply illustrative of methods and devices for making the invention and should not be viewed as limiting but only as examples. The scope of the invention should be measured by the appended claims.

I claim:

1. A wave riding device comprising:

a shape to said wave riding device that is substantially a quarter of a sphere, said wave riding device having a first end and a second end with said shape tapering from said second end towards said first end;

a bottom surface to said wave riding device between said first end and said second end, said bottom surface being essentially planar throughout, made from a buoyant material and tapering from said second end to said first end;

an arcuate top surface to said wave riding device attached to said bottom surface between said first end and said second end such that a cavity is formed between said bottom surface and said top surface, said top surface tapering from said second end towards said first surface, said arcuate top end being formed from said buoyant material;

a pair of opposing sides of said arcuate top surface attached to said bottom surface, said pair of opposing sides rising from said bottom surface and curving to meet above said bottom surface defining a height to said cavity;

a front surface formed on said quarter of said sphere at said first end by said opposing sides meeting at said first end;

an aperture defined by said cavity between said arcuate top surface and said bottom surface at said second end, said cavity having a cavity size that allows human fists to fit into said cavity, wherein said cavity is largest towards said second end and smallest towards said first end; and a handle inside said cavity having a pair of ends each being attached to one of said pair of opposing sides.

2. The wave riding device of claim 1 wherein said handle is formed of a different buoyant material than said buoyant material used to formed said bottom surface and said arcuate top surface.

3. The wave riding device of claim 1 wherein said cavity is large enough for human hands to fit inside said cavity of said wave riding device substantially up to the level of human wrists.

4. The wave riding device of claim 3 wherein a larger wave riding device is formed by placing two of said wave riding devices adjacent each other.

5. The wave riding device of claim 4 wherein a larger wave riding device is created by placing said bottom surfaces of two of said wave riding devices together.

6. The wave riding device of claim 1 wherein said wave riding device is formed by said top curved surface and said bottom surface being formed from a single piece.

7. The wave riding device of claim 1 further comprising;

the material used to form said handle is selected from at least one of the following: plastic materials; open cell foam; closed cell foam; fiberglass; metals; woods: polystyrene foam; inflatable materials; Nylon; or polyvinyl chloride (PVC); and the material used to form said curved top surface and said bottom surface is selected from at least one of the following: plastic materials; open cell foam; closed cell foam; fiberglass; metals; woods; polystyrene foam; or inflatable materials.

8. A wave riding device comprising:

a hand enclosure formed from buoyant materials, said hand enclosure having a flat bottom surface attached to a curved top surface to form a cavity in between said flat bottom surface and said curved top surface, said hand enclosure having a shape that tapers towards a first end from a second end;

an opening defined at said second end defined by said flat bottom surface and said curved top surface, said opening allowing entry of human hands into said cavity, said cavity being of a size and shape to enable human hands to fit within said cavity;

a front surface formed at said first end by said curved top surface rising perpendicularly with respect to said bottom surface at said first end;

a pair of opposing side walls extending between said curved top surface and said flat bottom surface, said pair of opposing side walls rising perpendicularly from edges of said flat bottom surface between said first end and said second end to form a flat side surface for each of said opposing side walls, said flat side surface existing on said opposing side walls throughout a majority of a distance between said first end and said second end; and a holding device within said cavity, said holding device being attached to interior portions of said pair of opposing sides, said holding device being accessible through said opening.

9. The wave riding device of claim 8 wherein said bottom surface is has a substantially semi-circular or semi-elliptical shape at said first end.

10. The wave riding device of claim 8 wherein said pair of opposing sides are symmetrical about a longitudinal axis of said bottom surface that proceeds from said first end to said second end, said longitudinal axis dividing said bottom surface into halves.

11. The wave riding device of claim 8 wherein said cavity is of a size and shape such that moving water incident upon said opening enters said cavity and imparts energy to said wave riding device.

12. The wave riding device of claim 8 wherein said hand enclosure is shaped such that two of said hand enclosures can be worn on opposite hands of a user and placed together to form a larger wave riding device.

13. The wave riding device of claim 12 wherein two of said hand enclosures can be placed together to form said larger device, wherein said larger device is formed by placing two of said bottom surfaces next to each other.

14. The wave riding device of claim 8 wherein said buoyant hand enclosure is formed from material is selected from one of the following: plastic materials; open cell foam; closed cell foam; fiberglass; metals; woods; polystyrene foam; or inflatable materials; and wherein the material used to form the holding device is selected from at least one of the following:

plastic materials; open cell foam; closed cell foam; fiberglass; metals; woods; polystyrene foam; inflatable materials or polyvinyl chloride (PVC).

15. The wave riding device of claim 8 wherein the front surface contains a substantially flat area.

16. The wave riding device of claim 8 wherein the front holding device is formed from the same material as the enclosure.

17. The wave riding device of claim 8 wherein the wave riding device has flat surfaces on said curved top surface, on each of said pair of opposing sides and on said front surface that can be applied against moving water to capture energy from moving water.

* * * * *